US010001747B1

(12) United States Patent
Tamura et al.

(10) Patent No.: US 10,001,747 B1
(45) Date of Patent: Jun. 19, 2018

(54) IMAGE FORMING APPARATUS

(71) Applicant: FUJI XEROX Co., Ltd., Tokyo (JP)

(72) Inventors: Kazuya Tamura, Kanagawa (JP); Masafumi Kudo, Kanagawa (JP); Koji Udagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/713,965

(22) Filed: Sep. 25, 2017

(30) Foreign Application Priority Data

Jan. 26, 2017 (JP) ..... 2017-011821

(51) Int. Cl.
*G03G 21/20* (2006.01)
*G03G 15/01* (2006.01)
*G03G 15/20* (2006.01)

(52) U.S. Cl.
CPC ..... *G03G 21/206* (2013.01); *G03G 15/011* (2013.01); *G03G 15/2003* (2013.01); *G03G 15/2064* (2013.01)

(58) Field of Classification Search
USPC ..... 399/91–93, 94, 97, 98, 107, 110, 122
See application file for complete search history.

(56) References Cited

U.S. PATENT DOCUMENTS 5,307,132 A * 4/1994 Tsuchiya ..... G03G 15/0258 399/70
9,207,636 B1 * 12/2015 Hamada ..... G03G 21/203
9,429,886 B2 * 8/2016 Minagawa ..... G03G 15/2017
9,507,304 B2 * 11/2016 Umeno ..... G03G 15/2064

FOREIGN PATENT DOCUMENTS

JP 05-346717 A 12/1993
JP 2015-206963 A 11/2015

* cited by examiner

*Primary Examiner* — Hoan Tran
(74) *Attorney, Agent, or Firm* — Sughrue Mion, PLLC

(57) ABSTRACT

An image forming apparatus includes: a fusing unit that heats a toner image and fixes the toner image on a recording medium; an exhaust passage that allows air heated by the fusing unit to flow and discharges the air to an outside of the apparatus; a delivery unit that moves the air in the exhaust passage in a discharge direction; a target structural component to which the air is to be delivered; a ventilation passage that connects a portion on a downstream side of the delivery unit of the exhaust passage in the discharge direction and the target structural component, and that allows the air to flow; and an adjuster that adjusts a passage through which the air flows, at a branch point between the exhaust passage and the ventilation passage.

19 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2017-011821 filed on Jan. 26, 2017.

BACKGROUND

Technical Field

The present invention relates to an image forming apparatus.

SUMMARY

According to an aspect of the invention, there is provided an image forming apparatus including: a fusing unit that heats a toner image and fixes the toner image on a recording medium; an exhaust passage that allows air heated by the fusing unit to flow and discharges the air to an outside of the apparatus; a delivery unit that moves the air in the exhaust passage in a discharge direction; a target structural component to which the air is to be delivered; a ventilation passage that connects a portion on a downstream side of the delivery unit of the exhaust passage in the discharge direction and the target structural component, and that allows the air to flow; and an adjuster that adjusts a passage through which the air flows, at a branch point between the exhaust passage and the ventilation passage.

BRIEF DESCRIPTION OF THE DRAWINGS

Exemplary embodiments of the present invention will be described in detail based on the following figures, wherein.

DETAILED DESCRIPTION

Hereinafter, an exemplary embodiment for carrying out the present invention (simply referred to as an "exemplary embodiment") will be described with reference to the accompanying drawings.

First Exemplary Embodiment

Figure 1:
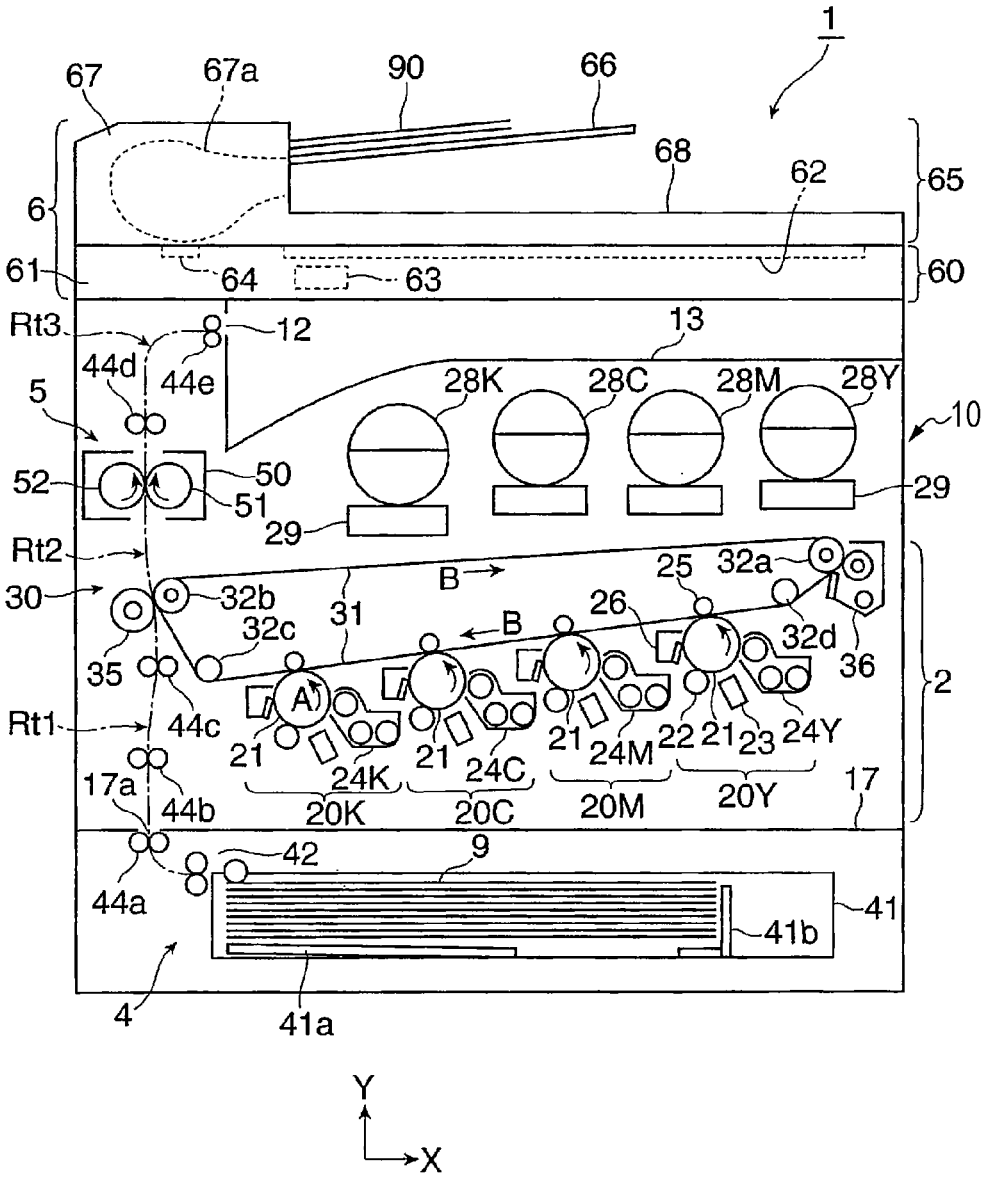
FIG. 1 is a schematic diagram illustrating the entire configuration of an image forming apparatus according to a first exemplary embodiment.
Figure 2:
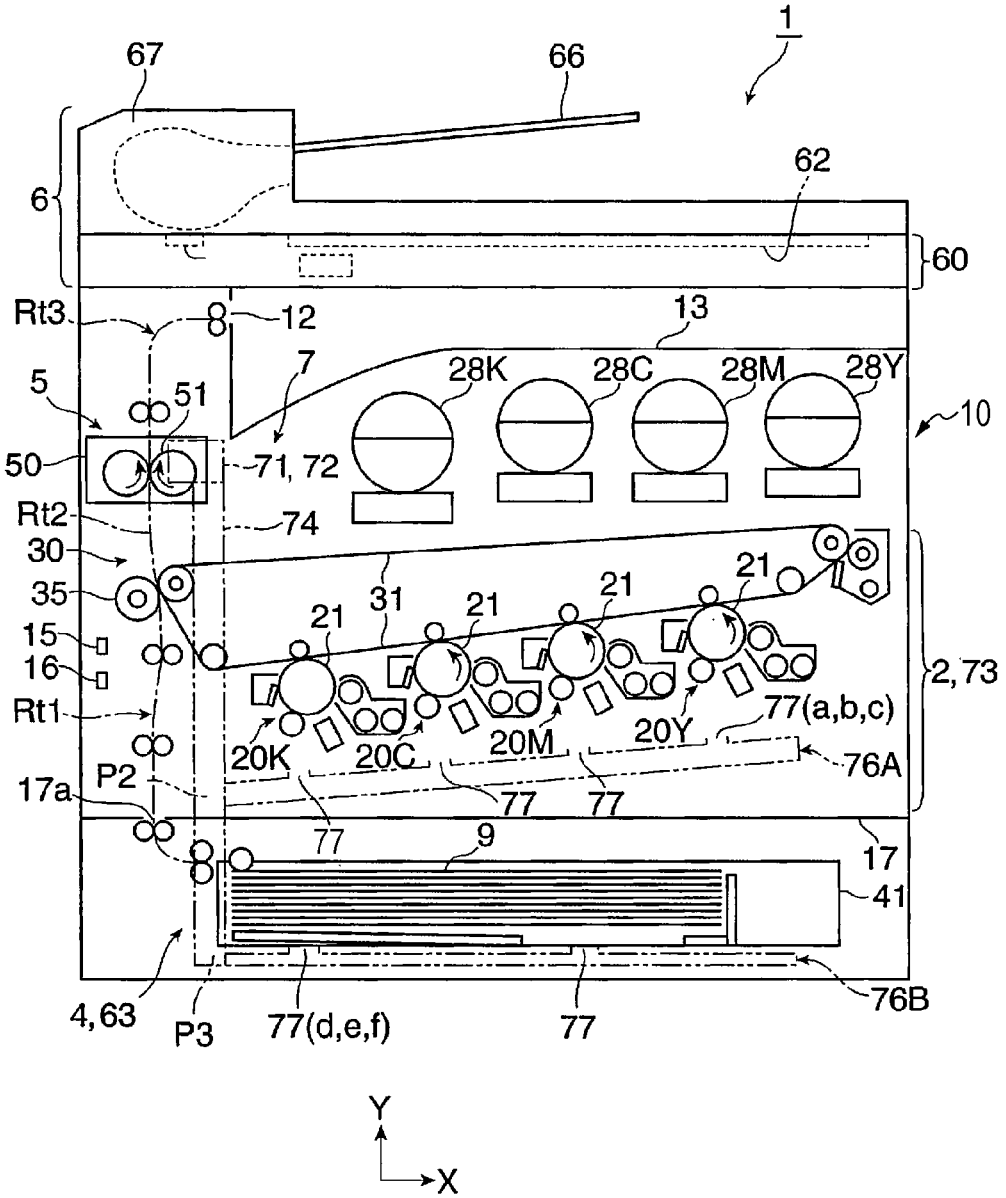
FIG. 2 is a schematic diagram additionally illustrating the configuration of a principal component (such as a blower device) in the image forming apparatus of FIG. 1.

FIG. 1 and FIG. 2 schematically illustrate the entire configuration of an image forming apparatus 1 according to a first exemplary embodiment.

<Configuration of Image Forming Apparatus>

The image forming apparatus 1 includes an imaging processor 2 that forms a toner image configurated by toner as a developer on a photoconductor; a paper feeder 4 that supplies a recording paper 9, which is an example of a recording medium, to the imaging processor 2; a fusing unit 5 that heats a toner image and fixes the toner image to the recording paper 9; and a document reader 6 that reads image information of a document 90 on which the image information on the toner image formed by the imaging processor 2 is recorded. The image information is information such as a character, a figure, a photograph, and coloring, for instance.

The arrows labeled with symbols X, Y, Z illustrated in each figure such as FIG. 1 are the (directions of) orthogonal coordinate axes that indicate the directions of the width, height and depth of three-dimensional space, assumed in the figure.

Also, the image forming apparatus 1 has a housing 10 with a box-shaped appearance in its entirety. The above-mentioned imaging processor 2, the paper feeder 4, and the fusing unit 5 are disposed inside the housing 10. In addition, the document reader 6 is disposed in a connected state above the housing 10.

In the housing 10, a support structure, an exterior section, and a partition space are formed using materials such as a support member, an exterior cover (including an opening-and-closing door), and a partition member. Also, a discharge port 12 through which the recording paper 9 with an image formed is discharged, and a discharge storage unit 13 for storing the recording paper 9 discharged through the discharge port 12 are provided in an upper portion of the housing 10. The dashed-dotted line illustrated in FIG. 1 and FIG. 2 indicates the main transport path for the recording paper 9 provided inside the housing 10.

The imaging processor 2 is mainly configurated by an imaging device 20 that forms a toner image corresponding to image information on a photoconductor drum which is an example of a photoconductor, and an intermediate transfer device 30 that holds the toner image formed in the imaging device 20 by first transfer, then transports the toner image to a second transfer position at which the toner image is secondarily transferred to the recording paper 9.

The imaging device 20 in the imaging processor 2 is configurated by using four imaging devices 20Y, 20M, 20C and 20K that individually form four color developer (toner) images of yellow (Y), magenta (M), cyan (C) and black (K), respectively.

As illustrated in FIG. 1, each of the four imaging devices 20 (Y, M, C, K) is mainly configurated by a photoconductor drum 21, a charging device 22, an exposure device 23, a developing device 24, a first transfer device 25, and a drum cleaning device 26. In the first exemplary embodiment, four imaging devices 20 (Y, M, C, K) are disposed at an approximately central portion of the internal space of the housing 10 with the imaging devices 20K, 20C, 20M, 20Y arranged in an inclined manner at gradually higher positions in that order. It is to be noted that although the imaging device 20Y is labeled with the symbols (21 to 26) of devices that configurate the imaging devices 20, the imaging devices 20M, 20C, 20K other than the imaging device 20Y are labeled with only part of the symbols with some symbols omitted.

Among those, as the photoconductor drum 21, for instance, a drum-shaped photoconductor with an image carrier surface formed is adopted, the image carrier surface having an optical dielectric layer (photosensitive layer) composed of a photosensitive material on the circumferential surface of a cylinder-shaped or column-shaped conductive base material to be grounded. Also, the photoconductor drum 21 is provided so as to receive power from a rotational driving device (not illustrated) and to be rotationally driven in the direction indicated by an arrow A.

The charging device 22 charges the image carrier surface of the outer circumferential surface of each photoconductor drum 21 to a desired potential. As the charging device 22, for instance, a contact-type charging device is adopted, the charging device including a contact member such as a charging roller which is disposed in contact with at least the image carrier surface of the photoconductor drum 21 and from which a charging current is supplied.

The exposure device 23 radiates an image formation surface of each photoconductor drum 21 after being charged with the light dispersed to the color components (Y, M, C, K) based on the image information, and forms an electrostatic latent image of each color component. As the exposure device 23, for instance, a non-scanning type exposure device configurated using a light emitting diode and an optical part is adopted. In the exposure device 23, the image information of a document obtained by reading in the document reader 6, and the image information inputted from the outside are inputted as an image signal after desired processing is performed by an image processor (not illustrated).

The developing devices 24 (Y, M, C, K) respectively store toner of the above-mentioned four colors (Y, M, C, K) as the developer, and develop electrostatic latent images of respective color components as toner images of the four colors (Y, M, C, K) by supplying a color toner corresponding to each color component from a development roller, the electrostatic latent images being formed on the outer circumferential surfaces of respective photoconductor drums 21. The developing devices 24 (Y, M, C, K) are configurated so that a needed amount of developer for replenishment is replenished from removable and replaceable developer cartridges 28 (Y, M, C, K) that store developer (only toner or toner and carrier) for replenishment by color via a delivery device 29 for replenishment and a transport pipe (not illustrated).

The first transfer device 25 first transfers a toner image on each photoconductor drum 21 to (an intermediate transfer belt 31 of) the intermediate transfer device 30 mainly by an electrostatic effect. As the first transfer device 25, for instance, a contact-type transfer device is adopted, the transfer device including a contact member such as a first transfer roller, which is in contact with a surface portion, at a first transfer position, of the photoconductor drum 21 (with the intermediate transfer belt 31 interposed) to be rotationally driven, and from which a first transfer current is supplied.

The drum cleaning device 26 cleans the photoconductor drum 21 by removing unwanted substances such as toner remaining on the outer circumferential surface of the photoconductor drum 21.

The intermediate transfer device 30 in the imaging processor 2 is configurated by components including the intermediate transfer belt 31, multiple support rollers 32*a* to 32*d* that rotatably support the intermediate transfer belt 31, a second transfer device 35, and a belt cleaning device 36. The intermediate transfer device 30 is disposed at a position upward of the imaging devices 20 (Y, M, C, K) in a slightly inclined state according to an arrangement state of the imaging devices 20.

Among those, as the intermediate transfer belt 31, for instance, an endless-shaped belt is adopted, which uses materials obtained by dispersing a resistance adjustment agent such as carbon to a base material such as a polyimide resin, and which achieves desired thickness and electrical resistance value. Also, the support roller 32*a* as a drive roller receives power from a rotational driving device (not illustrated), thereby driving the intermediate transfer belt 31 to rotate in the direction indicated by arrow B.

The multiple support rollers 32*a* to 32*d* hold and rotatably support the intermediate transfer belt 31 in a desired state from the inner circumferential surface thereof so that the outer circumferential surface passes through the first transfer position (a portion at which each photoconductor drum 21 and the first transfer device 25 are opposed to each other) in each imaging device 20 (Y, M, C, K). The support roller 32*a* is configurated as a drive roller that causes the intermediate transfer belt 31 to rotate and as a tension applying roller that applies tension to the intermediate transfer belt 31, the support roller 32*b* is configurated as a backup roller for second transfer, and the support rollers 32*c*, 32*d* are configurated as a surface forming roller that holds so as to form a first transfer surface of the intermediate transfer belt 31.

The second transfer device 35 secondarily transfers a toner image on the intermediate transfer belt 31 to the recording paper 9 mainly by an electrostatic effect. As the second transfer device 35, for instance, a contact type transfer device is adopted, the transfer device including a contact member such as a second transfer roller, which is in contact with an outer circumferential surface portion of the intermediate transfer belt 31, supported by the support roller 32*b* to be rotationally driven, and from which a second transfer current is supplied. The second transfer current may be configurated to be supplied to the support roller 32*b* serving as a backup roller for second transfer.

The belt cleaning device 36 cleans the intermediate transfer belt 31 by removing unwanted substances such as paper powder, remaining and adhering toner on an outer circumferential surface portion of the intermediate transfer belt 31, which has passed through a portion (second transfer position) with which the second transfer device 35 comes into contact.

The paper feeder 4 is mainly configurated by a paper storage unit 41, and a delivery device 42. The paper feeder 4 is disposed at a position (the lowermost portion) on the lower side of the imaging processor 2.

Among those, the paper storage unit 41 stores multiple stacked sheets of the recording paper 9 of desired size, type, on which an image is to be formed. As the paper storage unit 41, for instance, a tray-style storage unit is adopted, which includes a loading plate 41*a* for loading the recording paper 9, and a positioning member 41*b* that aligns and positions the ends of the recording paper 9. The paper storage unit 41 is attached to the housing 10 in a drawable manner. Also, multiple paper storage units 41 are provided as needed.

The delivery device 42 delivers the recording paper 9 one by one from the paper storage unit 41 to a sheet transport path. When multiple paper storage units 41 are provided, the delivery device 42 is individually disposed in each paper storage unit 41.

The fusing unit 5 is configurated as a fusing device that mainly includes a housing 50, a rotation unit 51 for heating, and a rotation unit 52 for pressure. The fusing unit 5 is disposed at a position on the upper side of (the intermediate transfer device 30 of) the imaging processor 2 and close to the discharge port 12 of the housing 10.

Among those, the housing 50 is a box-shaped structure that is provided with an introduction port and a discharge port for the recording paper 9, and that has thermal insulation properties.

The rotation unit 51 for heating is a roller-shaped or belt-shaped heater that is rotationally driven in a desired direction indicated by an arrow, and is heated by a heater (not illustrated) so that the surface temperature is held at a desired temperature. As the rotation unit 51 for heating, for instance, a roller-shaped heating roller is adopted. However, a belt-shaped heating roller may be adopted. Also, in the rotation unit 51 for heating, a surface temperature of the outer circumferential surface is detected by a temperature sensor (not illustrated), and the operation of the heater is controlled according to a result of the detection, and thus the surface temperature is held at a desired temperature.

The rotation unit 52 for pressure is a pressurizer that comes into contact with the rotation unit 51 for heating by a desired pressure substantially along the rotational axis direction of the rotation unit 51 for heating and is rotationally driven. As the rotation unit 52 for pressure, for instance, a roller-shaped pressure roller is adopted. However, a belt-shaped pressure roller may be adopted.

The fusing unit 5 is formed as a fusion processor in which the recording paper 9 carrying a toner image is introduced and fusion processing (pressurization and heating) is performed on a contact portion between the rotation unit 51 for heating and the rotation unit 52 for pressure.

As illustrated in FIG. 1 and FIG. 2, the housing 10 is provided with a supply transport path Rt1 for transporting the recording paper 9 from the delivery device 42 of the paper feeder 4 to the second transfer position in the intermediate transfer device 30 of the imaging processor 2, a relay transport path Rt2 for transporting the recording paper 9 from the second transfer position of the imaging processor 2 to the fusing unit 5, and a discharge transport path Rt3 for transporting the recording paper 9 from the fusing unit 5 to the discharge port 12.

The supply transport path Rt1 is configurated by components including multiple transport roller pairs 44*a* to 44*c* and a transport guide material (not illustrated). Particularly, the transport roller pair 44*c* is configurated as a resist roller pair that has typical functions such as adjustment of timing of transport of the recording paper 9 to the second transfer position, and correction of a transport posture (skew) of the recording paper 9. The relay transport path Rt2 is configurated by a transport guide material (not illustrated) or the like. The discharge transport path Rt3 is configurated by components including multiple transport roller pairs 44*d*, 44*e* and a transport guide material (not illustrated). Also, the transport roll pair 44*e* is configurated as a discharge roller that transports the recording paper 9 which is to be delivered to the discharge storage unit 13.

Figure 3:
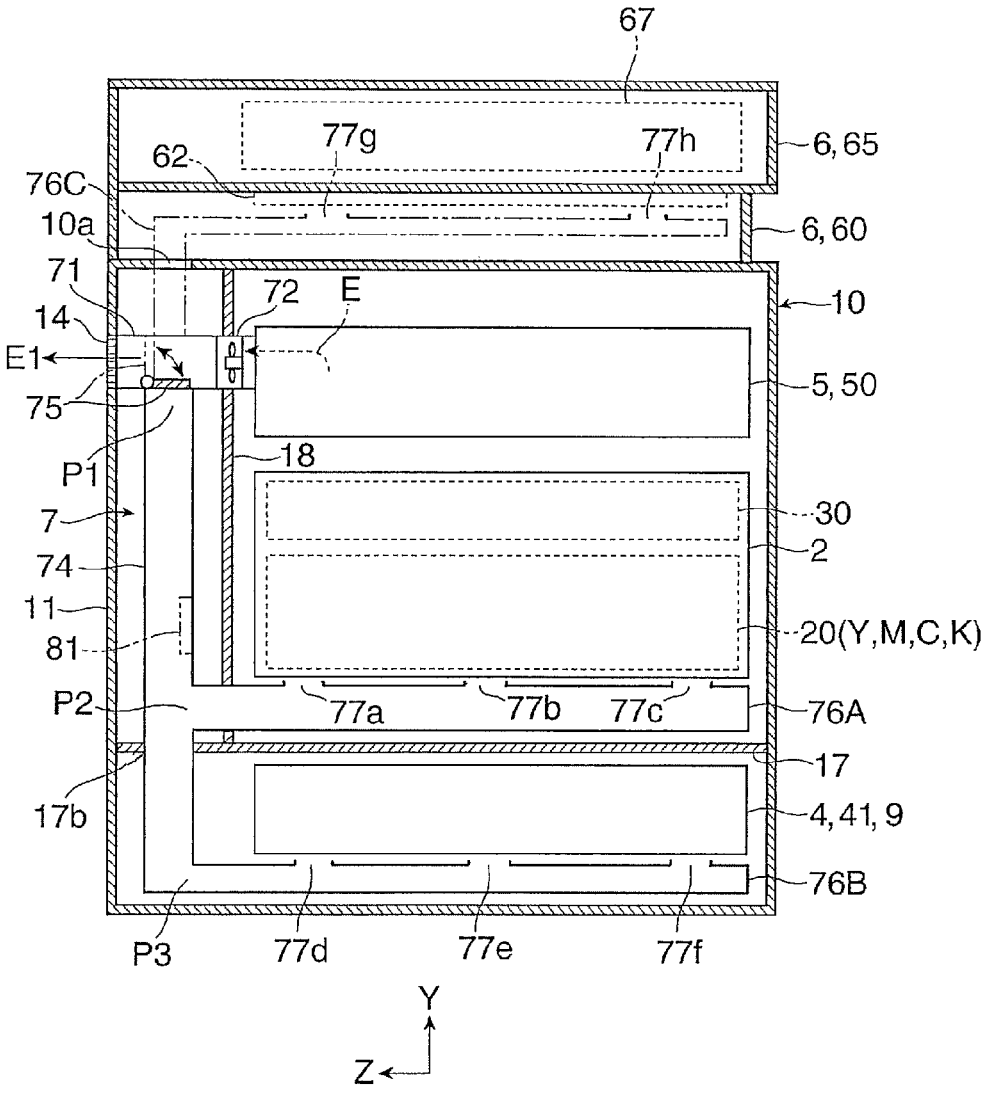
FIG. 3 is a longitudinal sectional schematic diagram illustrating the state of the configuration of the principal component as viewed from the lateral side in the image forming apparatus of FIG. 2.

As illustrated in FIGS. 1 to 3, in the housing 10 in the first exemplary embodiment, a vertical partition member 17 extending in an approximately horizontal direction is disposed between the imaging processor 2 and the paper feeder 4. This allows the paper feeder 4 to be disposed in an independent partitioned space. In the vertical partition member 17, for instance, a paper passage port 17*a*, which configurates part of the supply transport path Rt1, is formed. Incidentally, a configuration may be adopted, in which the paper feeder 4 is disposed in another housing independent from the housing 10 in which the imaging processor 2 is disposed.

As illustrated in FIG. 3, in the housing 10, a front-back partition plate 18 extending in an approximately vertical direction is disposed on the back side of the imaging processor 2 and the fusing unit 5. Thus, the housing 10 has a structure in which space is present between the back side of the imaging processor 2 and the fusing unit 5, and a back plate 11 of the housing 10. In the space on the back side of the front-back partition plate 18, for instance, a drive device and a rotation transmission device of the imaging processor 2 and the fusing unit 5, and a power supply unit (not illustrated) are disposed.

The imaging processor 2 selects and operates all or part (toner of at least multiple colors) of the imaging devices 20 (Y, M, C, K), thereby making it possible to form a multicolor image configurated by combining multiple colors of all colors or partial colors of the toner of four colors (Y, M, C, K). In addition, the imaging processor 2 may operate one of the imaging devices 20 (Y, M, C, K), thereby making it possible to form a single-color image configurated by toner of one color such as black, for instance.

The document reader 6 is configurated by a main body 60 and a movable unit 65. The document reader 6 is disposed to occupy a position on the upper side of the housing 10.

The main body 60 is configurated by a thin box-shaped housing 61, a document table 62 provided for fixedly placing the document 90 to be read on part of the upper surface of the housing 61, a movable reading unit 63 disposed in an internal space under the document table 62 of the housing 61, a fixed reading unit 64 disposed in an internal space under an upper surface portion of the housing 61, where the document table 62 is not present, and an operation panel (not illustrated) provided on the front side of an upper surface portion of the housing 61.

Among those, the document table 62 is formed using a light transparent plate material (such as platen glass).

The movable reading unit 63 is a reading device in a form that causes reflection light to form an image in a fixed imaging element and the image is read, the reflection light being obtained by radiating the image information of the document 90 placed on the document table 62 with an illumination light source or a reflector to be moved for scanning, and an optical component such as a lens in a space on the lower side of the document table 62.

The fixed reading unit 64 is a reading device in a form that causes reflection light to form an image in a fixed imaging element and the image is read, the reflection light being obtained by radiating the image information of the document 90 transported by the later-described document transport device (67) in the movable unit 65 with an illumination light source and an optical component fixed in the housing 10, the document 90 being passed through a light transparent reading window provided at one-side end of the upper surface portion of the housing 10.

The movable unit 65 is configurated to swing around an end as a fulcrum on the back side above the upper surface portion of the main body 60 in its entirety, and to serve as a cover that opens and closes the document table 62 and the fixed reading window mainly.

Also, the movable unit 65 is provided with a plate-shaped document storage member 66 on which the document 90 is placed in a stacked manner, and a document transport device 67 that transports a sheet one by one along a transport path 67*a* indicated by a dotted line so that the image information of the document 90 placed on the document storage member 66 is read by the fixed reading unit 64.

In addition, on the upper surface portion other than the document transport device 67, the movable unit 65 is provided with a document discharge surface 68 for discharging the document 90 for which reading by the fixed reading unit 64 is completed.

The image information of the document 90 read and obtained by the movable reading unit 63 or the fixed reading unit 64 of the document reader 6 is sent to relevant units such as an image processor, a storage (not illustrated) disposed inside the housing 10.

<Basic Image Forming Operation>

In the image forming apparatus 1, the below-described basic image forming operation is performed. Here, an example of forming a multi-color image, so-called a full-color image configurated by combining toner images of four colors (Y, M, C, K) will be described.

When the image forming apparatus 1 receives a command to request an image forming operation (a print operation or a copy operation) by its controller, a toner image is formed in a similar manner in the four imaging devices 20 (Y, M, C, K) in the imaging processor 2. When a command to request a copy operation is received, before a toner image forming operation is performed in the imaging devices 20 (Y, M, C, K), an operation of reading image information which is a copy source of the document 90 is performed by the document reader 6.

First, in each imaging device 20 (Y, M, C, K) in the imaging processor 2, a corresponding photoconductor drum 21 is rotationally driven in the direction indicated by arrow A, and the charging device 22 charges the image carrier surface of the photoconductor drum 21 to desired polarity (for instance, negative polarity) and potential.

After the charging, the exposure device 23 performs exposure (radiation of light) on the image carrier surface of the photoconductor drum 21 according to image signals dispersed to the four color components (Y, M, C, K) and transmitted based on the image information. At this point, in the case of a print operation, exposure is performed based on the image information inputted from the outside of the image forming apparatus 1. Also, in the case of a copy operation, exposure is performed based on the read image (image information) which is read by the document reader 6. The exposure causes an electrostatic latent image of each color component configurated at a predetermined potential to be individually formed on the image carrier surface of a corresponding photoconductor drum 21.

Subsequently, each developing device 24 (Y, M, C, K) supplies toner of a corresponding color from a development roller to the portion of an electrostatic latent image in the color formed on the image carrier surface of a corresponding photoconductor drum 21, and develops the electrostatic latent image by electrostatically attaching the toner to the portion. Thus, an electrostatic latent image of a corresponding color component in each photoconductor drum 21 is developed as a toner image of one of the four colors (Y, M, C, K) corresponding to the color component.

Subsequently, a toner image of a corresponding color formed on the photoconductor drum 21 of each imaging device 20 (Y, M, C, K) is relayed by the intermediate transfer device 30 in the imaging processor 2, and is transferred to the recording paper 9.

First, in each imaging device 20 (Y, M, C, K), a toner image of a corresponding color formed on the photoconductor drum 21 is transported to the first transfer position facing the intermediate transfer belt 31 by the rotation of the photoconductor drum 21, then the toner image receives a transfer effect by the first transfer device 25 (an electrostatic effect mainly by a transfer electric field) at the first transfer position, and thus the toner image of the color is first electrostatically transferred to the outer circumferential surface of the intermediate transfer belt 31. The image carrier surface of each photoconductor drum 21 is cleaned by a corresponding drum cleaning device 26 after the first transfer.

Subsequently, in the intermediate transfer device 30, the toner image first transferred on the outer circumferential surface of the intermediate transfer belt 31 is transported to the second transfer position by the rotation of the intermediate transfer belt 31 in the direction indicated by arrow B. Meanwhile, in the paper feeder 4, in synchronization with the imaging timing of the imaging processor 2, desired recording paper 9 is transported from the paper storage unit 41 to the second transfer position through the supply transport path Rt1. Thus, the toner image on the intermediate transfer belt 31 receives a transfer effect by the second transfer device 35 (an electrostatic effect mainly by a transfer electric field) at the second transfer position, and thus the toner image is secondarily transferred to the recording paper 9 collectively. The outer circumferential surface of the intermediate transfer belt 31 is cleaned by the belt cleaning device 36 after the second transfer.

Finally, the toner image transferred to the recording paper 9 is fixed by the fusing unit 5.

First, the recording paper 9, for which the second transfer is completed by the intermediate transfer device 30 in the imaging processor 2, is separated from the outer circumferential surface of intermediate transfer belt 31, and then is transported to the fusing device of the fusing unit 5 through the relay transport path Rt2. Subsequently, in the fusing unit 5, the recording paper 9, to which the toner image has been transferred, is introduced to the fusion processor between the rotation unit 51 for heating and the rotation unit 52 for pressure, and is heated and pressurized. Thus, the toner forming the toner image is melted and fixed to the recording paper 9.

When an image is to be formed on one side of the recording paper 9 after the fusing is completed, the recording paper 9 is transported to the discharge port 12 through the discharge transport path Rt3, then is discharged and stored in the discharge storage unit 13.

By the image forming operation described above, the image forming apparatus 1 forms a full-color image configurated by combining toner images of the four colors on one side of a sheet of the recording paper 9.

At this point, a command to request an image forming operation indicates image formation on multiple sheets of the recording paper 9, a series of operations described above is repeated similarly for requested number of sheets.

<Configuration of Blower Device Utilizing Air Heated by Fusing Unit>

The image forming apparatus 1 includes a blower device 7 that utilizes air E heated by the fusing unit 5 (hereinafter also simply referred to as "heated air"). The heated air E is the air generated in the surroundings of the rotation unit 51 for heating of the fusing unit 5 when the rotation unit 51 is heated by a heater.

As illustrated in FIGS. 2 and 3, the blower device 7 includes an exhaust duct 71 which is an example of an exhaust passage that allows the heated air E heated by the fusing unit 5 to flow and to be discharged to the outside of the housing 10; a blower fan 72 which is an example of a deliverer that moves the heated air E in the exhaust duct 71 in the direction for discharge (discharge direction); an ventilation duct 74 which is an example of a ventilation passage that connects a portion on the downstream side of the blower fan 72 of the exhaust duct 71 in the discharge direction, and a target structural component 73 to which the heated air E has to be delivered, and that allows the heated air E to flow; and a switching device 75 which is an example of an adjuster that adjusts a passage for the heated air E at a branch point P1 between the exhaust duct 71 and the ventilation duct 74.

The exhaust duct 71 is a cylindrical passage that is provided to connect part of the housing 50 in the fusing unit 5 and an exhaust port 14 provided in the housing 10 of the image forming apparatus 1.

The part of the housing 50, to which one end of the exhaust duct 71 is connected is an upper surface portion or an upper portion of the lateral face out of the housing 50, in which the heated air E ascends and tends to gather. In part of the housing 50, a discharge guide port is formed, which allows the heated air E generated in the housing 50 to flow to the exhaust duct 71. Also, the exhaust port 14 to which the other end of the exhaust duct 71 is connected, is provided as an opening with a desired opening shape such as a quadrilateral on the side wall on the back side of the housing 10, for instance. Appurtenances such as a louver, a dust collecting filter are attached to the exhaust port 14 as needed.

The blower fan 72 generates an air current that causes the heated air E in the exhaust duct 71 to move in a discharge direction.

The blower fan 72 is disposed at a position closer to one end of or at a position of the one end of the exhaust duct 71 connected to part of the housing 50 in the fusing unit 5. Also, the blower fan 72 operates during a period after the main power supply of the image forming apparatus 1 is turned on until the main power supply is turned off. It is to be noted that the blower fan 72 may be configurated to increase or decrease the number of rotation according to, for instance, the level of the temperature of the heated air E or the surface temperature of the rotation unit 51 for heating.

The target structural component 73 is part of the components of the image forming apparatus 1, to which the heated air E has to be delivered. In the first exemplary embodiment, the imaging processor 2 and the paper feeder 4 are each selected as the target structural component 73.

The imaging processor 2 considered as the target structural component 73 has the main target of the photoconductor drum 21 in which latent image flow due to dew condensation may occur, for instance. Also, the paper feeder 4 considered as the target structural component 73 has the main target of the recording paper 9 stored in the paper storage unit 41, which is in a moisture-absorbed state or may absorb moisture, for instance.

The ventilation duct 74 is a cylindrical passage that is provided to connect a portion on the downstream side of the blower fan 72 of the exhaust duct 71 in the discharge direction, and the target structural component 73.

One end of the ventilation duct 74 connected to part of the exhaust ducts 71 is connected to a portion between the blower fan 72 of the exhaust duct 71 and the exhaust port 14. When one target structural component 73 is provided, the other end of the ventilation duct 74 connected to the target structural component 73 is disposed at a position in proximity to a range or a specific portion of the target structural component 73, to which the heated air E is actually desired to be delivered.

As described above, since the ventilation duct 74 in the first exemplary embodiment includes two target structural components 73, that is, the imaging processor 2 and the paper feeder 4, as illustrated in FIG. 2 and FIG. 3, a first branch passage 76A and a second branch passage 76B are provided, which individually connect the imaging processor 2 and the paper feeder 4 which are the target structural components 73. Also, for instance, as illustrated in FIG. 3, the ventilation duct 74 is disposed in the space on the back side of the paper feeder 4, reachable through the space on the back side of the front-back partition plate 18 of the housing 10, and a passage hole 17*b* provided in the vertical partition member 17.

The first branch passage 76A is a passage that connects the ventilation duct 74 and the imaging processor 2 which is the target structural component 73.

The first branch passage 76A is disposed at a position on the lower side of the imaging devices 20 (Y, M, C, K) in the imaging processor 2, for instance. Since the first branch passage 76A mainly delivers the heated air E to each of the photoconductor drums 21 of the imaging devices 20 (Y, M, C, K), the first branch passage 76A is formed as a flat box-shaped passage having the longitudinal length of the four imaging devices 20 (Y, M, C, K) in an arrangement direction, and the transverse width of each photoconductor drum 21 in an axial direction. Furthermore, on the upper surface of the box-shaped first branch passage 76A, multiple openings 77*a*, 77*b*, 77*c* with desired intervals are similarly provided as openings 77 in the axial direction of (totally four) photoconductor drums 21 of the four imaging devices 20 (Y, M, C, K).

The second branch passage 76B is a passage that connects the ventilation duct 74 and the paper feeder 4 which is the target structural component 73.

The second branch passage 76B is disposed at a position on the lower side of the paper storage unit 41 in the paper feeder 4, for instance. Also, since the second branch passage 76B delivers the heated air E mainly to the recording paper 9 stored in the paper storage unit 41 of the paper feeder 4, the second branch passage 76B is formed as a flat box-shaped passage having a planar shape substantially similar to the shape of the bottom surface of the paper storage unit 41. Furthermore, the upper surface of the box-shaped second branch passage 76B are provided with multiple openings 77*d*, 77*e*, 77*f* as openings 77 that face part of the bottom surface of the paper storage unit 41.

For instance, as illustrated in FIG. 3 and FIGS. 4A to 4C, the switching device 75 is configurated by a plate-shaped movable member that operates to switch the passage for the heated air E to one of the exhaust duct 71 and the ventilation duct 74 at the branch point P1 between the exhaust duct 71 and the ventilation duct 74; and a driver such as a motor, a solenoid (not illustrated) that moves the movable member to a position to close one of the exhaust duct 71 and the ventilation duct 74.

When the passage sections of the exhaust duct 71 and the ventilation duct 74 at the branch point P1 have the same shape and dimension, a member having approximately the same shape and dimension as those of the passage sections is used as the movable member. The movable member in this situation is mounted swingably around its lower end as a fulcrum, for instance, and is operated to be moved and switched to one of a position (FIG. 4A) to close (passage section of) the ventilation duct 74 and a position (FIG. 4B) to close (passage section of) the exhaust duct 71 by the power of the driver.

Also, the image forming apparatus 1 includes a temperature sensor 15 that detects a temperature inside the housing 10 (inside the apparatus), and a humidity sensor 16 that detects a humidity. For instance, as illustrated in FIG. 2, the temperature sensor 15 and the humidity sensor 16 are installed at positions on the periphery of the second transfer position of the imaging processor 2.

Also, in the image forming apparatus 1, the switching device 75 is configurated to operate according to results (a detected temperature and a detected humidity) detected by the temperature sensor 15 and the humidity sensor 16.

Figure 5:
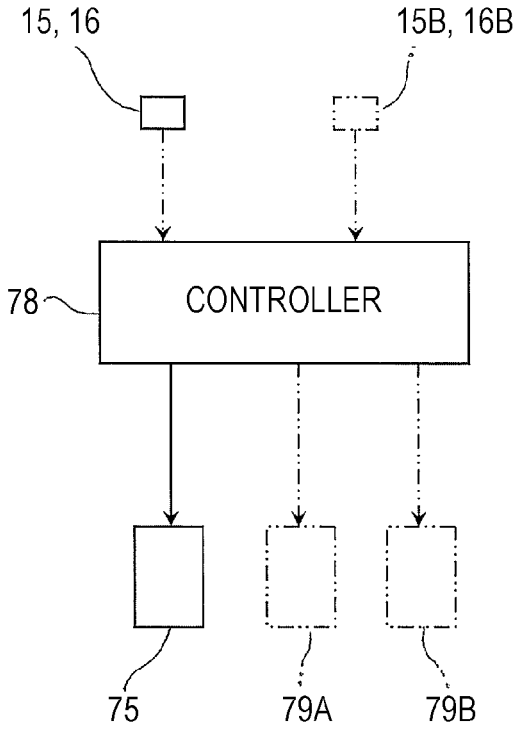
FIG. 5 is a block diagram illustrating the configuration of a control system in the principal component of FIG. 3.

Specifically, as illustrated in FIG. 5, a configuration is adopted in which information on the detection result by the temperature sensor 15 and the humidity sensor 16 is transmitted to a control unit 78 which is a controller that controls the operation of (the driver of) the switching device 75. Also, the control unit 78 is configurated to control the operation of the switching device 75 under preset conditions according to the detection result of the temperature sensor 15 and the humidity sensor 16.

In the first exemplary embodiment, the control unit 78 adopts the settings that, when a detected temperature becomes lower than or equal to a predetermined temperature (for instance, a predicted temperature which may cause dew condensation to occur) or a detected humidity becomes higher than or equal to a predetermined humidity (for instance, a predicted humidity which may cause the recording paper 9 to absorb moisture), allow the switching device 75 to pass the heated air E through the ventilation duct 74. Consequently, when a detected temperature becomes lower than or equal to a predetermined temperature or when a detected humidity becomes higher than or equal to a predetermined humidity, the control unit 78 controls the operation of the switching device 75 to pass the heated air E through the ventilation duct 74. However, otherwise, the control unit 78 controls the operation of the switching device 75 to pass the heated air E through the exhaust duct 71.

Also, information on a predicted temperature and a predicted humidity in the vicinity of the imaging processor 2 and the paper feeder 4 serving as target structural components 73 is applied to a temperature detected by the temperature sensor 15 and a humidity detected by the humidity sensor 16 used by the control unit 78, the information being obtained by prediction (or conversion) based on the actual temperature and humidity of the place where the sensors 15, 16 are installed. For calculation of a predicted temperature and a predicted humidity, correlation of the predicted temperature and humidity with actual detected temperature and humidity is examined by an experiment or the like in advance, and a predicted temperature and a predicted humidity are determined by conversion formula and contrast data derived from the correlation.

The control unit 78 is configurated by, for instance, an arithmetic processing unit, a storage element, an input/output device, a storage device, and is disposed at a predetermined portion in the housing 10. The control unit 78 operates based a control program and desired data stored in the storage element or the storage device. Incidentally, the control program and the data include programs and data related to the control of the above-mentioned switching device 75. The control unit 78 is configurated as a dedicated controller for the blower device 7 or configurated to be included as a partial function of a central control unit of the image forming apparatus 1.

<Operation of Blower Device>

Figure 4A:
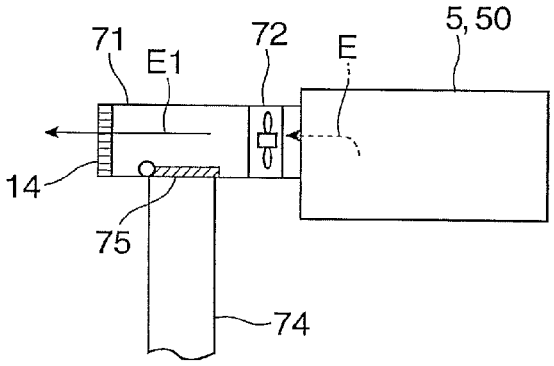
FIGS. 4A to 4C are each an explanatory diagram illustrating an operation state of a switching device in the principal component of FIG. 3.

In the blower device 7 that utilizes the heated air E generated in the fusing unit 5, when a temperature detected by the temperature sensor 15 is higher than a predetermined temperature, or a humidity detected by the humidity sensor 16 is lower than a predetermined humidity, as illustrated in FIG. 3 and FIG. 4A, control by the control unit 78 causes the switching device 75 to operate to pass the heated air E through the exhaust duct 71.

Specifically, the switching device 75 in this situation causes the movable member to move to a position to close the passage section at the branch point P1 of the ventilation duct 74, and achieves a state in which the passage section at the branch point P1 of the exhaust duct 71 is open.

Consequently, the heated air E generated from the heating by the rotation unit 51 for heating in the housing 50 of the fusing unit 5 creates air current E1 that is passed as it is through the exhaust duct 71 by the blower effect of the blower fan 72, and is discharged to the outside of the housing 10 through the discharge outlet 14.

Consequently, the heated air E generated in the housing 50 of the fusing unit 5 is discharged to the outside of the housing 10 as illustrated in FIG. 3. The discharge of the heated air E prevents stagnation of the heated air E in the housing 10 and increase of the temperature in the housing 10 to an abnormal temperature.

It is to be noted that in this situation, the heated air E does not flow through the ventilation duct 74, thus is not delivered to the imaging processor 2 and the paper feeder 4 which are the target structural components 73.

Figure 4B:
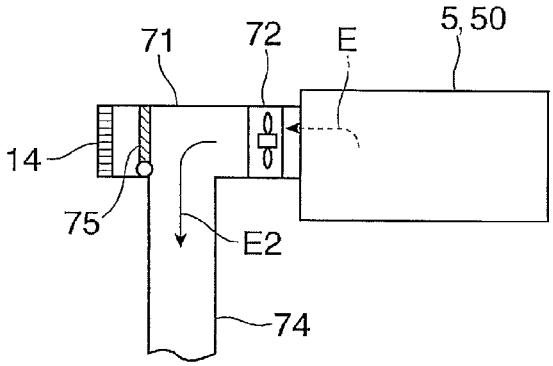
Figure 6:
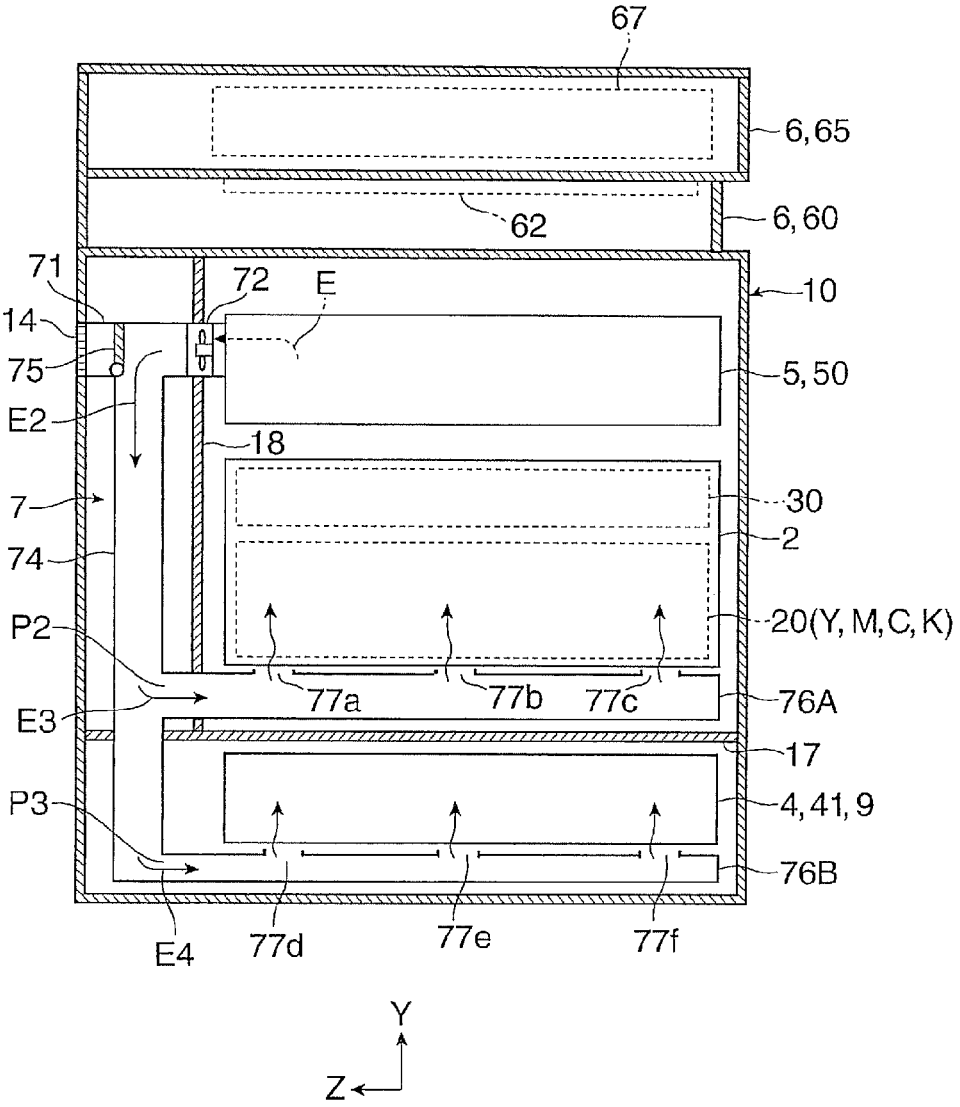
FIG. 6 is a longitudinal sectional schematic diagram illustrating one operation state of the principal component of FIG. 3.

On the other hand, in the blower device 7, when a temperature detected by the temperature sensor 15 is lower than or equal to a predetermined temperature, or a humidity detected by the humidity sensor 16 is higher than or equal to a predetermined humidity, as illustrated in FIG. 6 and FIG. 4B, control by the control unit 78 causes the switching device 75 to operate to pass the heated air E through the ventilation duct 74.

Specifically, the switching device 75 in this situation causes the movable member to move to a position to close the passage section at the branch point P1 of the exhaust duct 71, and achieves a state in which the passage section at the branch point P1 of the ventilation duct 74 is open.

Consequently, the heated air E generated in the housing 50 of the fusing unit 5 once flows in the exhaust duct 71 by the blower effect of the blower fan 72 as illustrated in FIG. 6, then the air path is changed at the branch point P1 by the movable member of the switching device 75, and creates air current E2 that flows to the ventilation duct 74. Subsequently, as illustrated in FIG. 4B, part of the air current E2 of the heated air E forms air current E3 that flows in the first branch passage 76A at branch point P2, and part of the remaining of the air current E2 forms air current E4 that flows in the second branch passage 76B at branch point P3.

As a result, as illustrated in FIG. 6, part of the heated air E generated in the housing 50 of the fusing unit 5 flows in the first branch passage 76A as the air current E3, then is discharged outside of the passage through the multiple openings 77*a*, 77*b*, 77*c*, and flows in (each of the imaging devices 20Y, 20M, 20C, 20K of) the imaging processor 2 which is the target structural component 73. Part of the remaining heated air E flows in the second branch passage 76B as air current E4, then is discharged outside of the passage through the multiple openings 77*d*, 77*e*, 77*f*, and flows in the paper feeder 4 which is the target structural component 73.

At this point, the heated air E flowed in the imaging processor 2 moves upward to the four imaging devices 20 (Y, M, C, K) disposed on the lower side of the imaging processor 2. Thus, in the imaging processor 2, although a problem such as latent image flow may occur resulting from dew condensation of particularly, the image carrier surface of each photoconductor drum 21 in the imaging devices 20 (Y, M, C, K) caused by an influence of, for instance, a low temperature environment (such as the morning in winter), the temperature around the photoconductor drum 21 is increased by the delivered heated air E, and thus formation of dew condensation is prevented.

At this point, the heated air E flowed in the paper feeder 4 moves upward to the paper storage unit 41 and the periphery. Thus, in the paper feeder 4, although favorable image formation may not be achieved due to moisture absorption by the recording paper 9 stored in the paper storage unit 41, caused by, for instance an influence of a high humidity environment, the ambient temperature of the recording paper 9 is increased by the delivered heated air E, and thus moisture absorption by the recording paper 9 is prevented.

Incidentally, the heated air E flowed in the imaging processor 2 is substantially blocked by the imaging devices 20 (Y, M, C, K) and is hardly delivered to the intermediate transfer device 30 disposed on the upper side of the imaging processor 2 or is delivered to part of the intermediate transfer belts 31 (an outer circumferential surface portion which serves as the first transfer surface) facing the imaging devices 20 at most, and a further passage is not formed and the heated air stagnates. Also, the heated air E flowed in the paper feeder 4 is substantially blocked by the vertical partition member 17 of the housing 10, and stagnates in the paper feeder 4.

Furthermore, the operation of passing the heated air E through the ventilation duct 74 is completed when a temperature detected by the temperature sensor 15 reaches a predetermined temperature or higher, or a humidity detected by the humidity sensor 16 reaches a predetermined humidity or lower (in other words, control by the control unit 78 causes the movable member of the switching device 75 to be displaced to a position to close the passage section of the ventilation duct 74). It is to be noted that the operation of passing the heated air E through the ventilation duct 74 may be terminated, for instance, after elapse of a predetermined desired time.

As described above, since the image forming apparatus 1 is provided with the blower device 7, the heated air E generated in the fusing unit 5 can be delivered to the imaging processor 2 and the paper feeder 4 which are the target structural components 73 when necessary.

For this reason, in the image forming apparatus 1, it is possible to avoid delivery of the heated air E in a place and time period where the heated air E is not needed as in the configuration in which the heated air E is constantly delivered to the imaging processor 2 and the paper feeder 4 which are the target structural components 73. The place where the heated air E is not needed is, for instance, the fusing unit 5, the developer cartridges 28, and some of the multiple imaging devices 20 configurating the imaging processor 2 during a time period when the heated air E is not needed. Also, a time period where the heated air E is not needed is, for instance, when a temperature detected by the temperature sensor 15 is higher than a predetermined temperature, or a humidity detected by the humidity sensor 16 is lower than a predetermined humidity, and in general, is a time period during execution of an image forming operation.

Also, in the image forming apparatus 1, the heated air E can be delivered to the imaging processor 2 and the paper feeder 4 which are the target structural components 73 at an appropriate time, as compared with the case where the switching device 75 of the adjuster does not operate according to results (a detected temperature and a detected humidity) detected by the temperature sensor 15 and the humidity sensor 16.

Furthermore, in the image forming apparatus 1, the heated air E can be precisely delivered to each of the imaging processor 2 and the paper feeder 4 which are multiple target structural components 73, as compared with the case where the ventilation duct 74 as the ventilation passage are not provided with the first branch passage 76A and the second branch passage 76B that individually connect the imaging processor 2 and the paper feeder 4 which are the target structural components 73.

First Modification of First Exemplary Embodiment

Figure 4C:
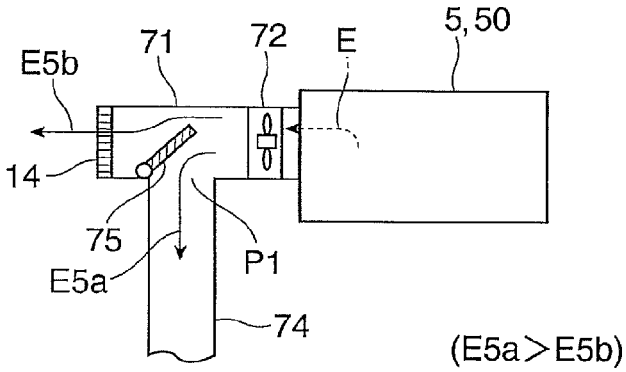

As illustrated in FIG. 4C, in the image forming apparatus 1 according to the first exemplary embodiment, for the switching device 75 of the adjuster in the blower device 7, the movable member may be configurated to be displaced to a position approximately in the middle of the position (FIG. 4A) to close the passage section of the exhaust duct 71 and the position (FIG. 4B) to close the passage section of the ventilation duct 74 at the branch point P1.

The configuration may be implemented, for instance, by controlling the movable member so that it can be stopped at any position. Also, the middle position at which the movable member is stopped may be preset according to a temperature detected by the temperature sensor 15 or a humidity detected by the humidity sensor 16, for instance.

When this configuration is adopted, the middle position at which the movable member of the switching device 75 is stopped is set as needed, thereby making it possible to adjust the amount of heated air E to be passed through the exhaust duct 71 and the ventilation duct 74. The movable member illustrated in FIG. 4A is stopped at a middle point to open a larger passage section of the ventilation duct 74 than the passage section of the exhaust duct 71.

Figure 7:
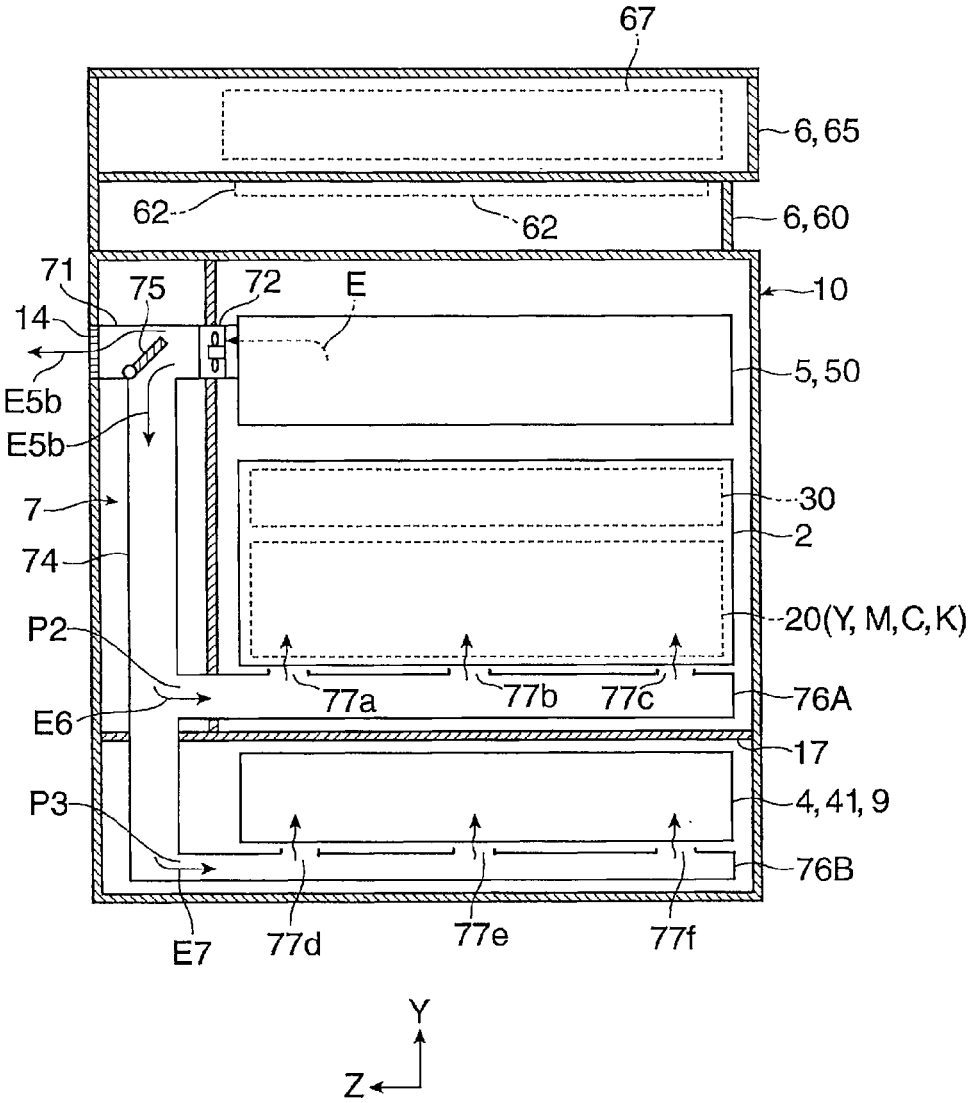
FIG. 7 is a longitudinal sectional schematic diagram illustrating one operation state in a first modification of the first exemplary embodiment.

In the image forming apparatus 1 to which the switching device 75 in this configuration is applied, when the movable member of the switching device 75 is stopped at the middle point, as illustrated in FIG. 7 and FIG. 4C, control by the control unit 78 causes the switching devices 75 to operate to pass the heated air E through both the exhaust duct 71 and the ventilation duct 74 with more amount of the heated air E passed through the ventilation duct 74 than the exhaust duct 71.

Consequently, the heated air E generated in the housing 50 of the fusing unit 5 once flows in the exhaust duct 71 by the blower effect of the blower fan 72, then the air path is changed at the branch point P1 by the movable member of the switching device 75, and part of the heated air E creates air current E5*a* that flows to the ventilation duct 74, and part of the remaining heated air E creates air current E5*b* that flows to the exhaust duct 71. At this point, a relationship holds: the amount of air in the air current E5*a* is greater than the amount of air in the air current E5*b* (E5*a*>E5*b*).

Consequently, it is possible to adjust (actually reduce) the amount of heated air E to be flowed in the target structural component 73. In this case, in addition to that part of the heated air E can be delivered to the target structural component 73, the remaining of the heated air E can be discharged to the outside of the housing 10 at the same time.

Incidentally, as illustrated in FIG. 7, the air current E5*a* flows through the ventilation duct 74 with a reduced amount, and part of the air current flows in the first branch passage 76A as air current E6, then is discharged outside of the passage through the multiple openings 77*a*, 77*b*, 77*c*, and flows in the imaging processor 2 which is the target structural component 73. Also, part of the remaining air current E5*a* with a reduced amount flows in the second branch passage 76B as air current E7, then is discharged outside of the passage through the multiple openings 77*d*, 77*e*, 77*f*, and flows in the paper feeder 4 which is the target structural component 73.

Second Modification of First Exemplary Embodiment

Figure 8A:
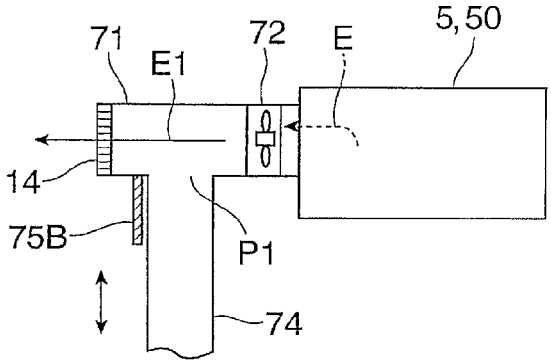
FIGS. 8A to 8C are each a schematic diagram illustrating the configuration and operation state of a switching device in a second modification of the first exemplary embodiment.
Figure 8B:
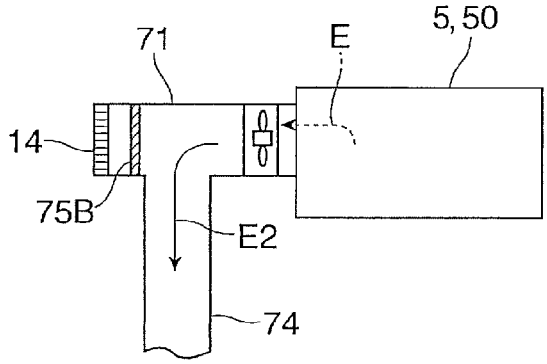
Figure 8C:
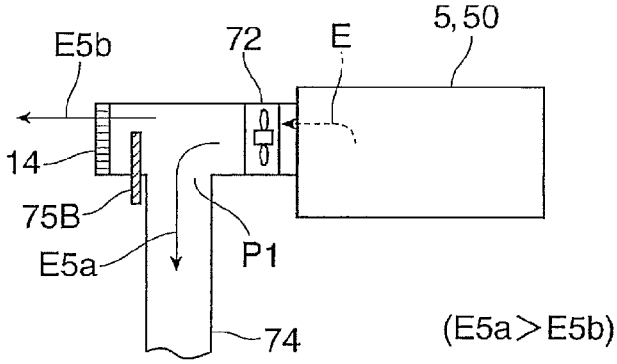

In the image forming apparatus 1 according to the first exemplary embodiment as illustrated in FIGS. 8A to 8C, as the switching device 75 of the adjuster in the blower device 7, a switching device 75B including a movable member that is displaced in a vertical direction along the passage section of the exhaust duct 71 may be used. The movable member of the switching device 75B may be configurated to be displaced to the position (FIG. 8A) to fully open the passage section of the exhaust duct 71, to the position (FIG. 8B) to close the passage section of the exhaust duct 71, or to the position (FIG. 8C) approximately in the middle of the position to fully open and the position to close at the branch point P1.

The switching device 75B in this configuration is effective, for instance, when the ventilation duct 74 crosses the exhaust duct 71 (or the blow direction of the blower fan 72) at nearly right angle, or crosses the side closer to the blower fan 72 (the side away from the exhaust port 14) at an acute angle. In other words, even when the passage section of the ventilation duct 74 at the branch point P1 is not in a closed state, the air current delivered by the blower fan 72 almost flows to the direction of the exhaust duct 71 due to a rectilinear force, and hardly flows to the direction of the ventilation duct 74 branching from the exhaust duct 71.

The switching device 75B, for instance, may control the movable member by the control unit 78 so that the movable member can be stopped at any position. Also, the middle position at which the movable member is stopped may be preset according to a temperature detected by the temperature sensor 15 or a humidity detected by the humidity sensor 16, for instance.

When the switching device 75B in this configuration is applied, by appropriately setting the middle position at which the movable member of the switching device 75B is stopped, it is possible to adjust that the heated air E is to be passed through which one of the exhaust duct 71 and the ventilation duct 74, and to adjust the amount of heated air E to be passed through each of the exhaust duct 71 and the ventilation duct 74. The movable member illustrated in FIG. 8C is stopped at a middle position to open a larger passage section of the ventilation duct 74 than the passage section of the exhaust duct 71.

In the image forming apparatus 1 to which the switching device 75B in this configuration is applied, when the movable member of the switching device 75B is stopped at a position to fully open the passage section of the exhaust duct 71 (FIG. 8A), the heated air E delivered by the blower fan 72 is passed as it is through the exhaust duct 71 as air current E1, then is discharged to the outside through the discharge outlet 14.

Also, when the movable member of the switching device 75B is stopped at a position to close the passage section of the exhaust duct 71 (FIG. 8B), the heated air E delivered by the blower fan 72 is passed through the ventilation duct 74 as air current E2 at the branch point P1, then is distributed between the first branch passage 76A and the second branch passage 76B, and is delivered to each the imaging processor 2 and the paper feeder 4 which are the target structural components 73. At this point, the air current E2 hardly flows in the ventilation duct 74 at the branch point P1 due to a rectilinear force.

Furthermore, when the movable member of the switching device 75B is stopped at a middle position to slightly open the passage section of the exhaust duct 71 (FIG. 8C), part of the heated air E delivered by the blower fan 72 is passed to the ventilation duct 74 as air current E5*a* with a reduced amount at the branch point P1, whereas the remaining heated air E is passed to the exhaust duct 71 as air current E5*b* (<E5*a*) with a reduced amount smaller than the flow rate of the air current E5*a*. Subsequently, air current E5*a* with a reduced amount flowed to the ventilation duct 74 is distributed between the first branch passage 76A and the second branch passage 76B, and is delivered to each the imaging processor 2 and the paper feeder 4 which are the target structural components 73 with a reduced amount.

Second Exemplary Embodiment

Figure 9:
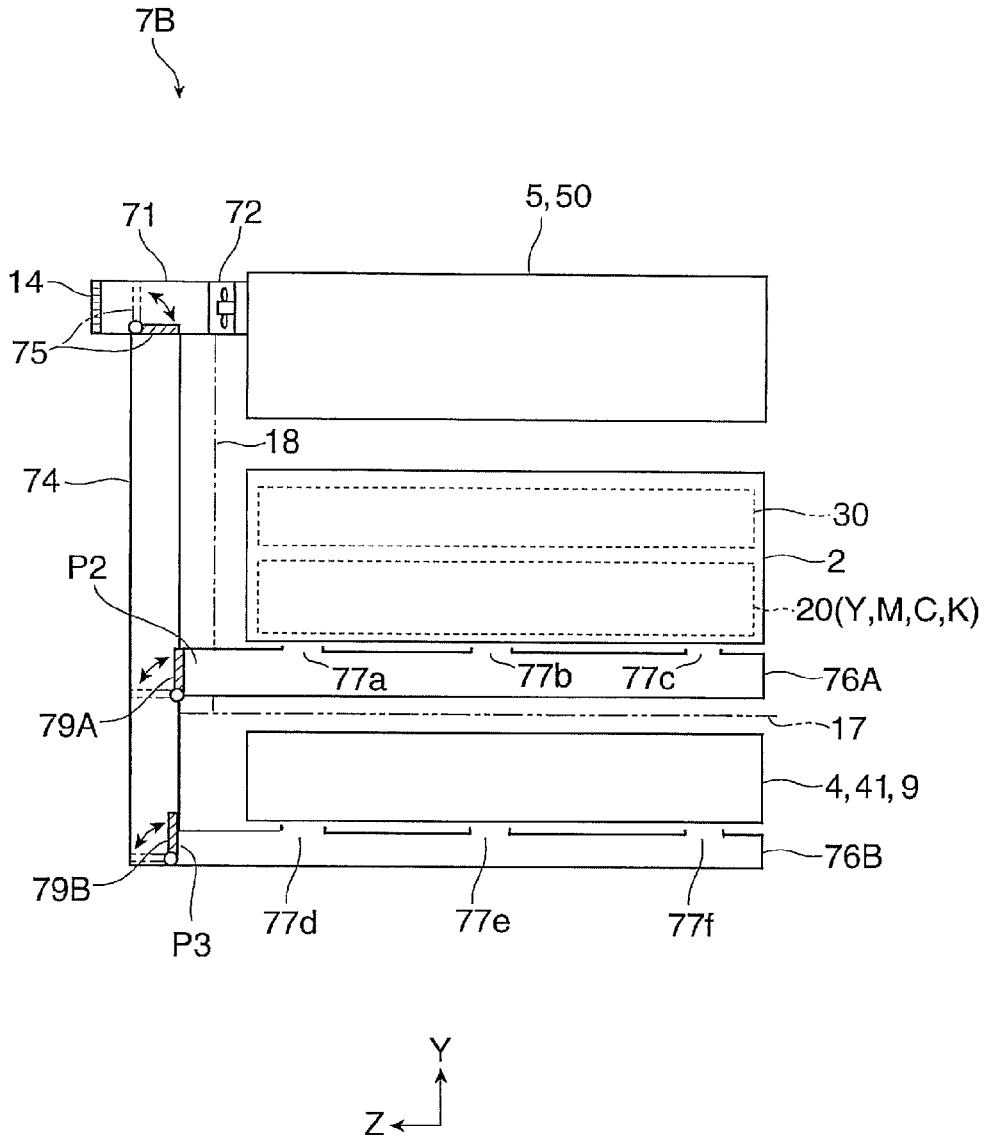
FIG. 9 is a schematic diagram illustrating the state of the configuration of the principal component as extracted and viewed from the lateral side in an image forming apparatus according to a second exemplary embodiment.

FIG. 9 illustrates principal components (mainly the blower device) of an image forming apparatus according to a second exemplary embodiment.

A blower device 7B in the image forming apparatus (1) has the same configuration as the configuration of the blower device 7 in the image forming apparatus 1 according to the first exemplary embodiment except that two branch points P2, P3 of the ventilation duct 74 are additionally provided with individual switching devices 79A, 79B which are each an example of an individual adjuster.

The blower device 7B is provided with a first individual switching device 79A at the branch point P2 from the ventilation duct 74 to the first branch passage 76A, and with a second individual switching device 79B at the branch point P3 from the ventilation duct 74 to the second branch passage 76B.

Similarly to the switching device 75 in the first exemplary embodiment, each of the first individual switching device 79A and the second individual switching device 79B is configurated by a plate-shaped movable member, and a driver that moves the movable member so as to be displaced at a predetermined position. Similarly to the switching device 75 in the first exemplary embodiment, each of the first individual switching device 79A and the second individual switching device 79B is configurated to operate according to a result detected by the temperature sensor 15 and the humidity sensor 16 by the control unit 78 (see the individual switching devices 79A, 79B indicated by chain double-dashed lines in FIG. 5).

In the image forming apparatus (1) including the blower device 7B, similarly to the blower device 7 according to the first exemplary embodiment, the control unit 78 controls the operation of the switching device 75, thereby making it possible to switch the passage to one of the exhaust duct 71 and the ventilation duct 74, and to pass the heated air E generated in the housing 50 of the fusing unit 5 through the switched passage.

Also, in the image forming apparatus (1), the control unit 78 controls the operation of the first individual switching device 79A and the operation of the second individual switching device 79B according to a result detected by the temperature sensor 15 and the humidity sensor 16, and thereby, for instance, the heated air E flowed in the ventilation duct 74 is passed to one of the first branch passage 76A and the second branch passage 76B, then can be finally passed to one of the imaging processor 2 and the paper feeder 4 which are the target structural components 73. Specifically, this can be implemented by placing the movable member of the first individual switching device 79A at a position to close the passage section of the ventilation duct 74 at the branch point P2, or placing the movable member of the first individual switching device 79A at a position to close the passage section of the first branch passage 76A at the branch point P2. It is to be noted that when the heated air E is simply passed to one of the first branch passage 76A and the second branch passage 76B, the second individual switching device 79B may not be disposed.

Also, in the second exemplary embodiment, similarly to the case of the switching device 75 in the first exemplary embodiment, the first individual switching device 79A and the second individual switching device 79B may be configurated to cause the movable member to be stopped at a middle position (see FIG. 4C).

When the first individual switching device 79A and the second individual switching device 79B in this configuration are applied, at least one of the movable member of the first individual switching device 79A and the movable member of the second individual switching device 79B is stopped at a middle position, thereby making it is possible to individually adjust (actually reduce) the amount of heated air E to be flowed from the ventilation duct 74 into each of the first branch passage 76A and the second branch passage 76B.

Furthermore, in the blower device 7B in the second exemplary embodiment, similarly to the case of the switching device 75 in the first exemplary embodiment, the switching device 75B is applicable instead of the switching device 75. In this case, the heated air E can be distributed between both the exhaust duct 71 and the ventilation duct 74 and passed therethrough, and the amount of heated air E to be passed through the ventilation duct 74 can also be adjusted.

Third Exemplary Embodiment

Figure 10:
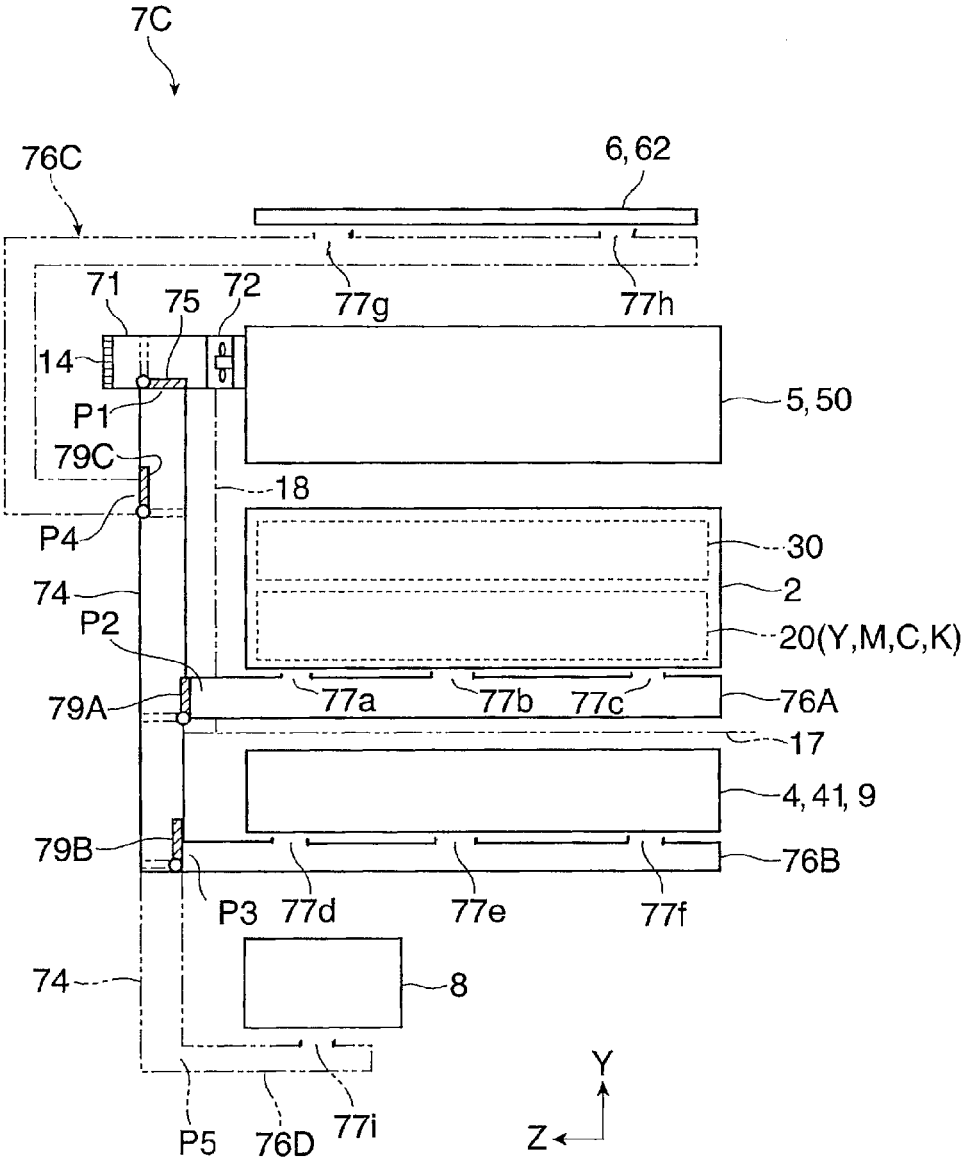
FIG. 10 is a schematic diagram illustrating the state of the configuration of the principal component as extracted and viewed from the lateral side in an image forming apparatus according to a third exemplary embodiment.

FIG. 10 illustrates principal components (mainly the blower device) of an image forming apparatus according to a third exemplary embodiment.

A blower device 7C in the image forming apparatus (1) has the same configuration as the configuration of the blower device 7 (7B) in the image forming apparatus 1 according to the first exemplary embodiment except that the document reader 6 and a power supply unit 8 are added as the target structural components 73, a third branch passage 76C connected to the document reader 6, and a fourth branch passage 76D connected to the power supply unit 8 are additionally installed in the ventilation duct 74, and a third individual switching device 79C is provided at a branch point P4 from the ventilation duct 74 to the third branch passage 76C.

The document reader 6 as a target structural component 73 assumes a target of particularly, a document table (such as a platen glass) 62 installed on the upper surface of the main body 60. Also, the power supply unit 8 as a target structural component 73 is such that a main power supply device and a circuit substrate in the image forming apparatus (1) are stored in a housing or the like. The power supply unit 8 is installed, for instance, in the space on the back side of the front-back partition plate 18 in the housing 10.

In the blower device 7C, for instance, one end of the third branch passage 76C is connected to a portion (branch point P4) between the branch point P1 of the exhaust duct 71 and the branch point P1 of the ventilation duct 74, and the other end is disposed on the lower side of the document table 62 through the inside of the main body 60 of the document reader 6. Multiple openings 77*g*, 77*h* are provided on the upper surface of part of the third branch passage 76C, disposed on the lower side of the document table 62. For reference, part of the third branch passage 76C is indicated by a chain double-dashed line in FIG. 3. When the third branch passage 76C is provided, a passage hole 10*a* is provided in part of the upper surface of the housing 10 (FIG. 3).

Also, in the blower device 7C, for instance, one end of the fourth branch passage 76D is connected to a portion (branch point P5) of the terminal end (extended portion) exceeding the branch point P2 of the exhaust duct 71, and the other end is disposed in the periphery on the lower side of the power supply unit 8. A desired opening 77*i* is provided on the upper surface of part of the fourth branch passage 76D, disposed on the lower side of the power supply unit 8.

Furthermore, in the blower device 7C, the third individual switching device 79C is provided at the branch point P4 from the ventilation duct 74 to the third branch passage 76C. The third individual switching device 79C is configurated in the same manner as the individual switching devices 79A, 79B in the second exemplary embodiment. Also, similarly to the individual switching devices 79A, 79B in the second exemplary embodiment, third individual switching device 79C is configurated to operate according to a result detected by the temperature sensor 15 and the humidity sensor 16 by the control unit 78.

In the image forming apparatus (1) including the blower device 7C, similarly to the blower device 7 according to the first exemplary embodiment, the control unit 78 controls the operation of the switching device 75, thereby making it possible to switch the passage to one of the exhaust duct 71 and the ventilation duct 74, and to pass the heated air E generated in the housing 50 of the fusing unit 5 through the switched passage.

Also, in the image forming apparatus (1), the control unit 78 controls the operation of each of the first individual switching device 79A, the second individual switching device 79B and the third individual switching device 79C according to a result detected by the temperature sensor 15 and the humidity sensor 16, and thereby, for instance, the heated air E flowed in the ventilation duct 74 is passed to one or multiple ones of the first branch passage 76A, the second branch passage 76B, the third branch passage 76C and the fourth branch passage 76D, then can be finally passed to one or multiple ones of the imaging processor 2, the paper feeder 4, the document reader 6 and the power supply unit 8.

For instance, when the heated air E flowed in the ventilation duct 74 is passed to the document reader 6 only, the movable member of the third individual switching device 79C may be set to a position to close the passage section at the branch point P4 of the ventilation duct 74. Also, when the heated air E flowed in the ventilation duct 74 is passed to the power supply unit 8 only, the movable member of the third individual switching device 79C may be set to a position to close the passage section at the branch point P4 of the third branch passage 76C, the movable member of the first individual switching device 79A may be set to a position to close the passage section at the branch point P2 of the first branch passage 76A, and the movable member of the second individual switching device 79B may be set to a position to close the passage section at the branch point P3 of the second branch passage 76B.

Here, the heated air E flowed into the document reader 6 through the third branch passage 76C is discharged through the multiple openings 77*g*, 77*h*, and moves upward to the document table 62 disposed on the upper side of the main body 60. Thus, in the document reader 6, although dew condensation may occur particularly on the document table 62 due to, for instance, an influence of a low temperature environment and a problem such as a reading failure may occur, the temperature around the document table 62 in the main body 60 is increased by the delivered heated air E, and thus formation of dew condensation is prevented.

Also, the heated air E flowed in the power supply unit 8 through the fourth branch passage 76D moves upward to the periphery of the housing or the inside of the housing. Thus, in the power supply unit 8, even when dew condensation forms in the components of the power supply unit 8 due to, for instance, an influence of a low temperature environment and a failure may occur, the ambient temperature and the internal temperature of the power supply unit 8 is increased by the delivered heated air E, and thus formation of dew condensation is prevented.

Also, in the third exemplary embodiment, in addition to the first individual switching device 79A and the second individual switching device 79B, similarly to the case of the switching device 75 in the first exemplary embodiment, third individual switching device 79C may be configurated to cause the movable member to be stopped at a middle position (see FIG. 4C).

When the individual switching devices 79A, 79B, 79C in this configuration are applied, at least one of the movable member of the first individual switching device 79A, the movable member of the second individual switching device 79B, and the movable member of the third individual switching device 79C is stopped at a middle position, thereby making it is possible to individually adjust (actually reduce) the amount of heated air E to be flowed from the ventilation duct 74 into each of the first branch passage 76A, the second branch passage 76B, the third branch flow passage 76C, and the fourth branch flow passage 76D.

Furthermore, also in the blower device 7C in the third exemplary embodiment, instead of the switching device 75, the switching device 75B illustrated in the second modification of the first exemplary embodiment may be applied. In this case, the heated air E can be distributed between both the exhaust duct 71 and the ventilation duct 74 and passed therethrough, and the amount of heated air E to be passed through the ventilation duct 74 can also be adjusted.

Other Exemplary Embodiments

In the first to third exemplary embodiments, configuration examples in which multiple target structural components 73 are adopted as the blower device 7 (7B, 7C) have been presented. However, the blower device may have a configuration in which the target structural component 73 is, for instance, one of the imaging processor 2, the paper feeder 4, the document reader 6, and the power supply unit 8. When a single target structural component 73 is provided, for instance, the terminal end of the ventilation duct 74 may be disposed at a position in proximity to the target structural component, and one or multiple openings may be provided as needed. In contrast, when multiple target structural components 73 are adopted, a combination of the multiple target structural components 73 may be selected in any manner.

Also, in the first to third exemplary embodiments, for the blower device 7 (7B, 7C), configuration examples, in which the operation of the switching device 75 (75B) of the adjuster is activated according to detected information on the internal temperature and humidity of the housing 10, have been presented. However, instead of or along with the above-mentioned configuration examples, the operation may be controlled as in the following configuration example.

Specifically, the configuration example is such that for instance, when the main power supply of the image forming apparatus 1 is turned on, at least one of the timing immediately before the start of an image forming operation and the timing immediately after the completion of an image forming operation, the switching device is operated so that the heated air E is passed through the ventilation duct 74 for a predetermined desired time. Here, the timing immediately before the start of an image forming operation refers to the time interval from the reception of a start command until start of an exposure process (latent image formation) in the imaging processor 2. Also, the timing immediately after the completion of an image forming operation refers to a desired time interval from the moment when the recording paper 9 having an image formed by the final image forming operation is discharged through the discharge outlet 12.

The specific timing may be an appropriate timing for delivering the heated air E to the target structural component 73, and may be a timing other than the timing illustrated above. Incidentally, such a configuration example in which the switching device is operated at specific timing may be applied to the operation of the individual switching devices 79A to 79D of individual adjusters. However, in a configuration where the heated air E is delivered to the paper feeder 4 during execution of an image forming operation, for instance, the recording paper 9 which has absorbed moisture is heated in the fusing unit 5 and vapor is generated, thereby causing the humidity of the heated air E to increase, which is not preferable.

Meanwhile, the blower device 7 (7B, 7C) may be configurated such that the temperature sensor 15 and the humidity sensor 16 are disposed at multiple locations inside the housing 10, the detected temperature and detected humidity obtained from the temperature sensor 15 and the humidity sensor 16 are comprehensively or individually utilized, and the operations of the switching device 75 (75B) of the adjuster and the individual switching devices 79A to 79D of the individual adjusters are controlled by the control unit 78 (see FIG. 5).

In this configuration, when particularly multiple temperature sensors 15 and humidity sensors 16 are disposed in a distributed manner in the periphery of multiple target structural components 73, it is possible to deliver the heated air E to each target structural component 73 at more appropriate timing and with a more appropriate amount as compared with the case where a single temperature sensor 15 and a single humidity sensor 16 are disposed and the operation of the switching device 75 (75B) of the adjuster is controlled.

Furthermore, in the first to third exemplary embodiments, for the blower device 7 (7B, 7C), the configuration example in which the ventilation duct 74 is disposed and provided only inside of the housing 10 has been presented. However, part of the ventilation duct 74 may be provided so as to be disposed outwardly of the housing 10. When part of the ventilation ducts 74 is disposed in this manner, part of the ventilation duct 74 through which the heated air E flows can be disposed away from a component for which unnecessary increase of the temperature is desired to be avoided. It is to be noted that as the installation position (layout manner) of the ventilation duct 74 and the branch passages 76 (A to D) in the blower device, for instance, unoccupied space in the housing 10 and a location where an existing member can be used as part of a passage may be utilized.

Optionally, in the first to third exemplary embodiments, at some midpoint of the ventilation duct 74 in the blower device 7 (7B, 7C), a Peltier element 81 may be disposed in a manner not interfering with the flow of heated air E as illustrated by a chain double-dashed line in FIG. 3.

For instance, when the heated air E is passed through the ventilation duct 74, even if the temperature of the heated air E gradually decreases as the heated air E moves away from the fusing unit 5, the operation of the Peltier element 81 as needed allows the heated air E to be reheated. The Peltier element 81 may be disposed in the branch passages 76 (A to D).

Also, dehumidification agent or the like may be disposed at relevant portions in the ventilation duct 74 and the branch passages 76 (A to D).

In addition, as long as an image forming apparatus has the fusing unit 5 that heats a toner image and fixes the toner image on the recording paper 9, the image forming apparatus in another configuration may be applied to the image forming apparatus 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fusing unit that heats a toner image and fixes the toner image on a recording medium;

an exhaust passage that allows air heated by the fusing unit to flow and discharges the air to an outside of the apparatus;

a delivery unit that moves the air in the exhaust passage in a discharge direction;

a target structural component to which the air is to be delivered;

a ventilation passage that connects a portion on a downstream side of the delivery unit of the exhaust passage in the discharge direction and the target structural component, and that allows the air to flow; and an adjuster that adjusts a passage through which the air flows, at a branch point between the exhaust passage and the ventilation passage.

2. The image forming apparatus according to claim 1, wherein the adjuster adjusts an amount of the air to be passed.

3. The image forming apparatus according to claim 2, further comprising a detector that detects a temperature and a humidity in the apparatus, wherein the adjuster operates according to a result of detection by the detector.

4. The image forming apparatus according to claim 3, wherein the adjuster operates to cause the air to flow through the ventilation passage at at least one timing of a time of turn-on of a main power supply, a time immediately before start of an image forming operation, and a time immediately after completion of an image forming operation.

5. The image forming apparatus according to claim 4, wherein the target structural component is one of a plurality of target structural components, and the ventilation passage is provided with branch passages or openings which individually connect the plurality of target structural components.

6. The image forming apparatus according to claim 3, wherein the target structural component is one of a plurality of target structural components, and the ventilation passage is provided with branch passages or openings which individually connect the plurality of target structural components.

7. The image forming apparatus according to claim 2, wherein the adjuster operates to cause the air to flow through the ventilation passage at at least one timing of a time of turn-on of a main power supply, a time immediately before start of an image forming operation, and a time immediately after completion of an image forming operation.

8. The image forming apparatus according to claim 7, wherein the target structural component is one of a plurality of target structural components, and the ventilation passage is provided with branch passages or openings which individually connect the plurality of target structural components.

9. The image forming apparatus according to claim 2, wherein the target structural component is one of a plurality of target structural components, and the ventilation passage is provided with branch passages or openings which individually connect the plurality of target structural components.

10. The image forming apparatus according to claim 1, further comprising a detector that detects a temperature and a humidity in the apparatus, wherein the adjuster operates according to a result of detection by the detector.

11. The image forming apparatus according to claim 10, wherein the adjuster operates to cause the air to flow through the ventilation passage at at least one timing of a time of turn-on of a main power supply, a time immediately before start of an image forming operation, and a time immediately after completion of an image forming operation.

12. The image forming apparatus according to claim 11, wherein the target structural component is one of a plurality of target structural components, and the ventilation passage is provided with branch passages or openings which individually connect the plurality of the target structural components.

13. The image forming apparatus according to claim 10, wherein the target structural component is one of a plurality of target structural components, and the ventilation passage is provided with branch passages or openings which individually connect the plurality of target structural components.

14. The image forming apparatus according to claim 1, wherein the adjuster operates to cause the air to flow through the ventilation passage at at least one timing of a time of turn-on of a main power supply, a time immediately before start of an image forming operation, and a time immediately after completion of an image forming operation.

15. The image forming apparatus according to claim 14, wherein the target structural component is one of a plurality of target structural components, and the ventilation passage is provided with branch passages or openings which individually connect the plurality of target structural components.

16. The image forming apparatus according to claim 1, wherein the target structural component is one of a plurality of target structural components, and the ventilation passage is provided with branch passages or openings which individually connect the plurality of target structural components.

17. The image forming apparatus according to claim 16, wherein at least part of the branch passages of the ventilation passage, which connect the plurality of target structural components, is provided with an individual adjuster that individually adjusts a passage through which the air is passed.

18. The image forming apparatus according to claim 17, wherein the individual adjuster adjusts an amount of the air to be passed.

19. The image forming apparatus according to claim 1, wherein the target structural component comprises one of an imaging processor that forms a toner image in a photoconductor, a medium storage that stores a recording medium to be supplied to the imaging processor, a power supply unit, and a document reader.

* * * * *